US006199865B1

(12) United States Patent
Goldman

(10) Patent No.: US 6,199,865 B1
(45) Date of Patent: Mar. 13, 2001

(54) LOGICAL GAME ELEMENT

(76) Inventor: Igor Goldman, 19700 Greenside Terrace, Gaithersburg, MD (US) 20879

( * ) Notice: Subject to any disclaimer, the term of this patent is extended or adjusted under 35 U.S.C. 154(b) by 0 days.

(21) Appl. No.: 09/163,376

(22) Filed: Sep. 30, 1998

(51) Int. Cl.[7] ..... A63F 3/00

(52) U.S. Cl. ..... 273/288; 273/153 R; 273/156; 273/157 R

(58) Field of Search ..... 273/153 R, 153 S, 273/157 R, 156, 155, 160, 288

(56) References Cited

U.S. PATENT DOCUMENTS 1,531,542 * 3/1925 Cogshall .
3,564,735 * 2/1971 Fisher .
3,566,827 * 3/1971 Moseley .
4,007,555 * 2/1977 Sasaoka .
4,410,179 * 10/1983 Rubik .
4,927,150 * 5/1990 Monoyios .
5,217,226 * 6/1993 Christopher .
5,272,929 * 12/1993 Fletcher .
5,558,331 * 9/1996 Zlotsky .
5,816,571 * 10/1998 Chen .
5,826,873 * 10/1998 Lavermicocca .

* cited by examiner

*Primary Examiner*—Sebastiano Passaniti
*Assistant Examiner*—Vishu Mendiratta
(74) *Attorney, Agent, or Firm*—I. Zborovsky

(57) ABSTRACT

A three dimensional logical game element has a body formed as a part of a three dimensional member, the body has a plurality of elements with corners whose apexes are removed on sides which are located in planes to be in contact and slide over one another during assembly or disassembly of at least two such elements, the body having at least one fixing member for fixing a position of the logical game element, the fixing member being formed as a projection.

15 Claims, 6 Drawing Sheets

LOGICAL GAME ELEMENT

BACKGROUND OF THE INVENTION

The present invention relates to logical game elements for games and puzzles.

Logical game elements of this general type are known in the art. The known logical game elements are formed for example as ¼ of cylinder, ¼ of gear, and ⅛ of a sphere. These logical game elements are disclosed in Soviet patent documents SU1 319,886; SU1 382,483; SU1 452,483; SU1 452,533; SU1 806810; and U.S. Pat. No. 4,410,179; 4,557,484; 4,708,345; 4,881,738; D281,339; 5,628,512; 5,370,394. The known logical game elements have several disadvantages. First of all, the surfaces of logical game elements do not have roundings or chamfer. This makes playing with them difficult or practically impossible, since the elements which move toward one another will be blocked by their corners when surfaces to be in contact with one another do not coincide. The presence of a great quantity of the elements in the game makes a probability of the blocking close to 100%.

The logical game elements do not have fixing means for fixing of their position. This makes the games uncomfortable and tiring, since a player must monitor all the time the correct position of the elements relative to one another, and to correct this position. Otherwise, the toys can rotate, displace, etc.

The surface of the logical game elements do not have distinguishing marks, pictures, reliefs or simply openings or slots for special inserts. Therefore, the possibility of their use in the games is limited, its attractiveness is reduced, and they can not be used by people with certain disadvantages for example blind people.

SUMMARY OF THE INVENTION

Accordingly, it is an object of present invention to provide a logical game element which avoids the disadvantages of the prior art.

More particularly, it is an object of present invention to provide a logical game element which is more convenient and attractive to play with, which can be used for developing of new games with a greater attractiveness and new functional properties, such as therapeutical properties and properties to develop a logical thinking and space imagination, as well as which can be used by blind people, and also which can be used for construction sets.

In keeping with these objects and with others which will become apparent hereinafter, one feature of present invention resides, briefly stated, in a logical game element which is formed as a part of a spacial figure, for example a cylinder, a gear, a sphere, and has surfaces which are rounded in corners, or chamfered in corners, on sides which are located in planes to be in contact and slide over one another during assembly or disassembly of at least two such elements.

In accordance with another feature of present invention, the logical game element has projections formed on its cylindrical surface or fixing members on the spherical surface formed as extensions, recesses or flat portions.

The logical game element also can have a front slot formed as a dovetail, rectangle or another shape, which can be open or closed, open or in other words not closed at an apex of the logical game element. The base of the front slot can have at least one opening for fixing of an insert. The logical game element has an insert which is formed with the shape corresponding to the shape of the front slot and which has on its face surface a relief, a mark or an image. The base of the insert can have at least one setting projection for fixing in the front gap.

The logical game element can have, on its front surface, a relief, mark, image or projection, and the relief, mark and image can be formed on the projection.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1A:
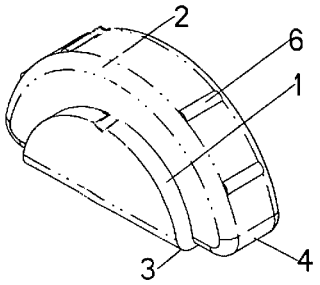
FIG. 1A is a prospective view of a logical game element formed as one half of the cylinder, with members formed as recesses on the projections.
Figure 1B:
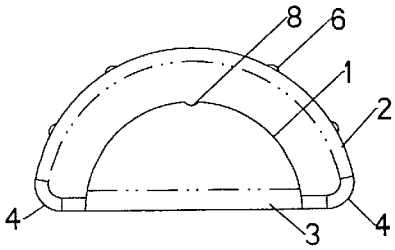
FIGS. 1B and 1C are views showing the logical game element of FIG. 1A from the front and from the right.
Figure 1C:
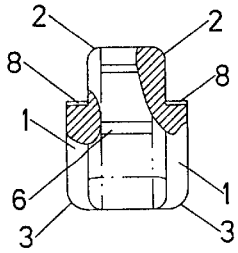
Figure 1D:
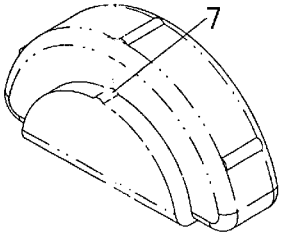
FIG. 1D is a perspective view of a logical game element formed as one half of a cylinder with fixing members formed as steps on projections.
Figure 1E:
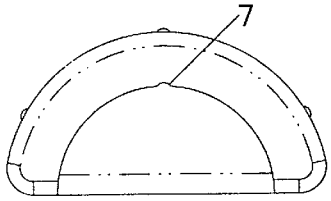
FIGS. 1E and 1F are view s showing the logical game element of FIG. 1D from the front and from the right.
Figure 1F:
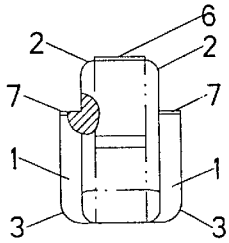

A logical game element in accordance with the present invention can be formed as a part of a cylinder, for example ½, ¼, ⅙, etc. At both sides of the element, it is provided with projections 1, as shown for example in FIGS. 1A, 1B, 1C, 2A, 2B, etc. Regardless of the shape of the logical game element, the projections 1 are formed as a part of a body of revolution, or in other words as a part of a cylinder or a part of a sphere.

Front surfaces of the logical game element which is formed as a part of a cylinder or a gear are provided at both sides with radii 2 as shown in FIGS. 1A, 1C, 1F, 7A, 8A, 8C, 9A, 9C, 10C. The radii 2 can be replaced with chamfers (which are shown in hidden lines on the FIG. 1C). The surfaces of the projections 1 near a base are also rounded from two sides. In other words, they are provided with a radii 3 as shown in FIGS. 1A, 1B, 1C, 1F, 2B, 3B, 8C, 9C, 10C. The radii 3 can be also replaced by chamfers (which are shown in hidden lines on the FIG. 1C).

The surfaces which are formed by intersection by a cylinder or a gear with planes into several parts (main surfaces of the logical game element), are rounded from two sides by radii 4, as shown for example in FIGS. 1A, 1B, 2A, 2B, 3A, 3B, 3D, 8B, 9B, 10B. They are rounded between themselves with radii 5 as shown for example in FIGS. 2A, 2B, 2D, 3B, 3D, 9B, 10A, 10B.

Both the radii 2 and 3 as well as the radii 4 and 5 can be replaced by chamfers. However, the use of the radii instead of the chamfers is preferable, since it makes the displacement of the logical game elements in the games smoother, without jumps and blocking.

The outer surface of the logical game element can be provided with a relief 6 formed as a predetermined number of marks and lines, such as for example in FIGS. 1A, 1B, 2C, 2D, 2E, 2G, 2K, 2M. They can be used both for providing a logical order of elements in the process of a game, for for example to arrange the elements in accordance with the order I, II, III, IIII, and also for playing by deaf people With touching of the elements.

Figure 1G:
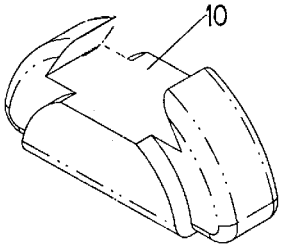
FIG. 1G is a view showing a logical game element formed as of a cylinder with a front slot having a shape of dovetail and with fixing members formed as a smooth surface on the projections.
Figure 1H:
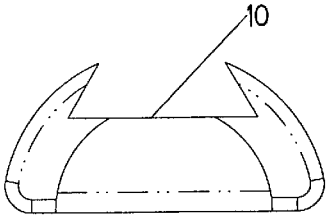
FIG. 1H is a view of the logical game element of 1D from the front.
Figure 1K:
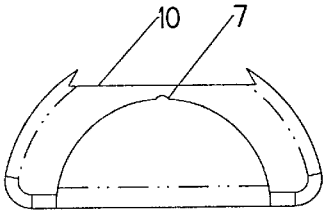
FIG. 1K is a front view of a logical game element formed as ½ of a cylinder, with a front slot with a shape of dovetail and with fixing members formed as steps on the projection.

The projections 1, or at least one of the projections, or in other words from at least one from side of the logical game element, fixing members for fixing a position of the element are provided. The fixing members are formed as steps 7, as recesses 8, or as double steps 9 as shown in FIGS. 1B, 1E, 2B, 3D, 3F. The logical game elements can be also provided with a front slot formed as a dovetail 10, as shown for example in FIGS. 1G, 2A, as a rectangle 11 as shown for example in FIGS. 1L, 1M, 1N or can be provided with flat 12 on an apex as shown for example in FIGS. 1O, 1P. The base of the slots 10 and 11 or the flat 12 which is located below the upper point of the projection can also serve for fixing a position of the logical game element, as shown for example in FIGS. 1H, 1N.

Figure 1L:
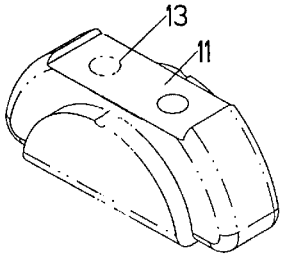
FIG. 1L is a perspective view of a logical game element formed as ½ half of a cylinder with a front slot having a rectangular-cross-section with fixing members formed as recesses on the projections and with setting openings on a surface of sections.
Figure 1M:
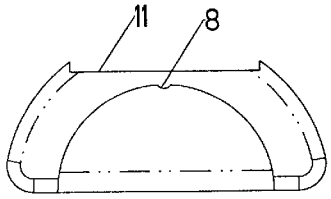
FIG. 1M is a view showing the logical game element of FIG. 1L from the front.
Figure 1N:
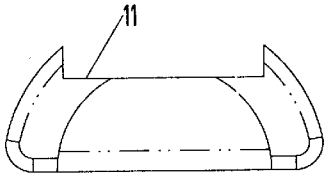
FIG. 1N is a front view of a logical game element formed as ½ of a cylinder, with a front slot formed as a rectangular section, with fixing members formed as a flat surface on the projections and with setting openings on the surface of sections.
Figure 1O:
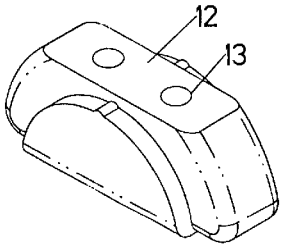
FIG. 1O is a perspective view of a logical game element formed as ½ of a cylinder with a front slot with a rectangular cross-section with fixing members formed as steps on the projections and with setting openings on the surface of section.
Figure 1P:
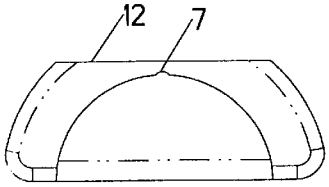
FIG. 1P is a view showing the logical game element of 1O from the front.
Figure 2A:
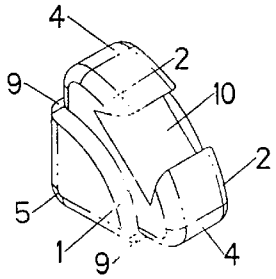
FIG. 2A is a view showing a logical game element formed as ¼ of a cylinder, with a front slot having a shape of a dovetail and with fixing members formed as steps on the projection.
Figure 2B:
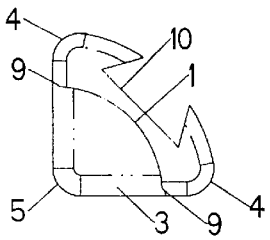
FIG. 2B is a view showing the logical game element of FIG. 2A from the front.
Figure 2C:
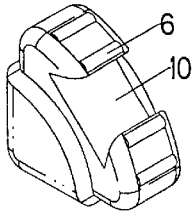
FIG. 2C is a perspective view of a logical game element formed as ¼ of a cylinder, with a front slot having shape of a dovetail, with fixing members formed as steps on the projections, with four reliefs (or projections, marks) on the cylindrical part of the logical game element.
Figure 2D:
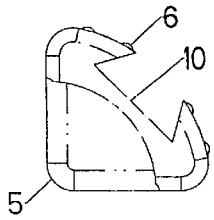
FIG. 2D is a view showing the logical game element of FIG. 2C from the front.
Figure 2E:
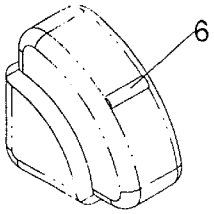
FIG. 2E is a perspective view of a logical game element formed as ¼ of a cylinder, with fixing members formed as steps on the projections, with one relief (or projection mark) on the cylindrical part of the logical game element.
Figure 2F:
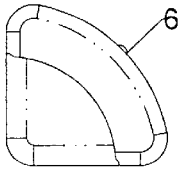
FIG. 2F is a front view of the logical game element of FIG. 2E.
Figure 2G:
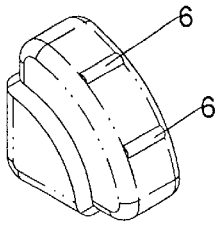
FIG. 2G is a perspective view of a logical game element formed as ¼ of a cylinder, with fixing members formed as steps on the projections, with two reliefs (or projections) marks, on the cylindrical part of the logical game element.
Figure 2H:
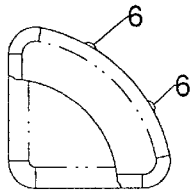
FIG. 2H is a front view of the logical game element of FIG. 2G.
Figure 2K:
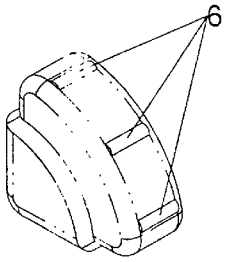
FIG. 2K is a perspective view of a logical game element formed as ¼ of a cylinder, with fixing members formed as steps on the projections, with three reliefs (or projections, marks) on the cylindrical part of the logical game element.
Figure 2L:
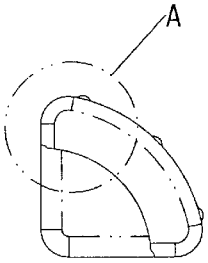
FIG. 2L is a front view of the logical game element of FIG. 2K.
Figure 2M:
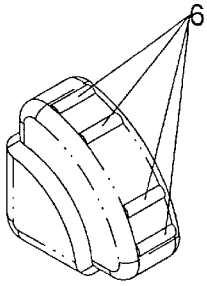
FIG. 2M is a perspective view of a logical game element formed as ¼ of a cylinder, with fixing members formed as steps on the projections, with four reliefs (or projections, marks) on the cylindrical part of the logical game element.
Figure 2N:
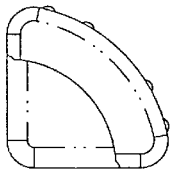
FIG. 2N is a front view of a logical game element of FIG. 2M.
Figure 2O:
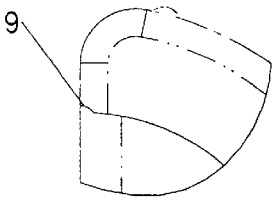
FIG. 2O is a detailed enlarged view A of a part of the logical game element of FIG. 2L.
Figure 3A:
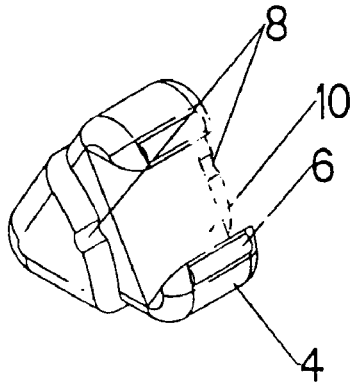
FIG. 3A is a perspective view of a logical game element formed as ⅙ of a cylinder, with a front groove having a shape of a dovetail, with fixing members formed as recesses on the projections, with two relieves, (or projections, marks) on the cylindrical part of the logical game element.
Figure 3B:
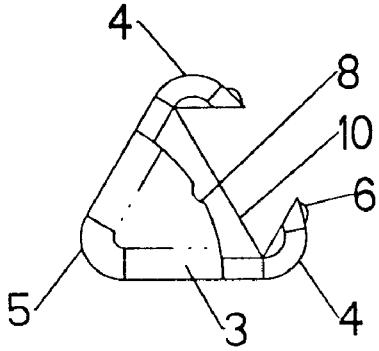
FIG. 3B is a front view of the logical game element of FIG. 3A.
Figure 3C:
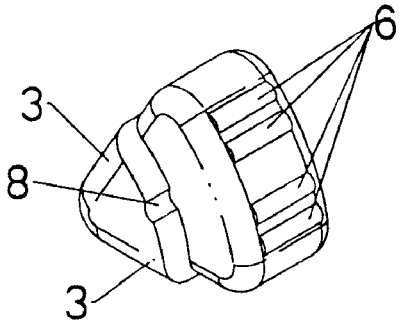
FIG. 3C is a perspective view of logical game element formed as ⅙ of a cylinder, with fixing members formed as recesses on the projections, with four relieves (or projections, marks) on the cylindrical part of the logical game element.
Figure 3D:
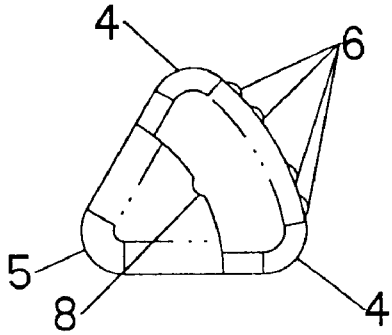
FIG. 3D is a front view of the logical game element of FIG. 3C.
Figure 3E:
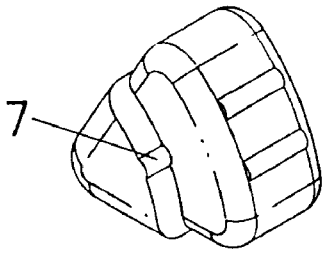
FIG. 3E is a perspective view of a logical game element formed as ⅙ of a cylinder, with fixing members formed as steps on the projections, with two relieves (or projections, marks) on the cylindrical part of the logical game element.
Figure 3F:
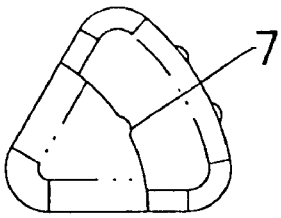
FIG. 3F is a front view of the logical game element of FIG. 3E.

At least one setting opening 13 can be provided on the base 11 or 12 as shown in FIGS. 1L, 1O. Generally, the front slot 10 can be formed as any shape, which is open or in other words not closed, near an apex of the logical game element. The provision of the front slot 10, 11 or the flat 12 makes possible to use inserts 14, 15, 16 which are provided for expanding of functional and gaming possibilities of the logical game element.

Figure 4A:
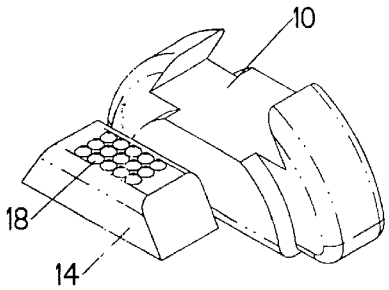
FIG. 4A is a perspective exploded view of a logical game element of FIG. 1G, with an insert formed as a dovetail.
Figure 4B:
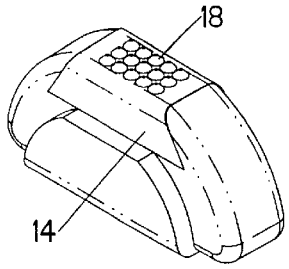
FIG. 4B is an assembled view of the logical game element of FIG. 4A.
Figure 4C:
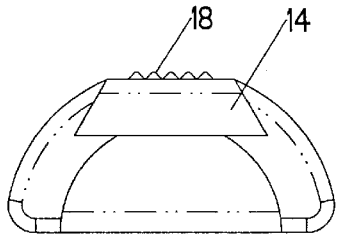
FIG. 4C is a front view of the logical game element of FIG. 4B.
Figure 5A:
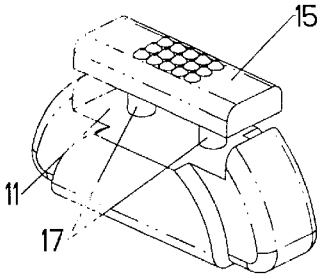
FIG. 5A is a perspective exploded view of a logical game element of FIG. 1N with an insert formed as rectangular bar with two supports.
Figure 5B:
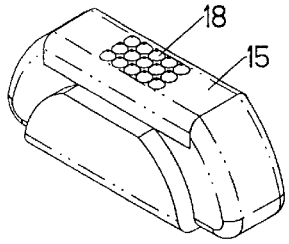
FIG. 5B is an assembled view of the logical game element of FIG. 5A.
Figure 5C:
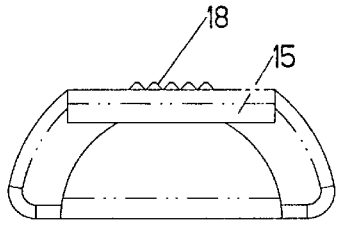
FIG. 5C is a front view of the logical game element of FIG. 5B.
Figure 6A:
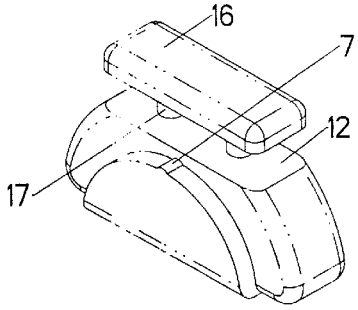
FIG. 6A is a perspective exploded view of a logical game element of FIG. 1O with an insert formed as rectangular bar with two supports.
Figure 6B:
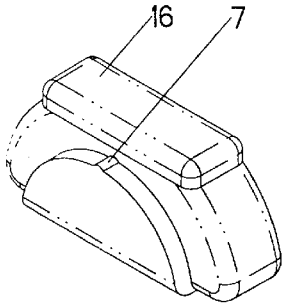
FIG. 6B is an assembled view of the logical game element of FIG. 6A.
Figure 6C:
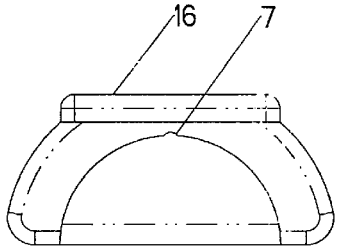
FIG. 6C is a front view of the logical game element of FIG. 6A.
Figure 7A:
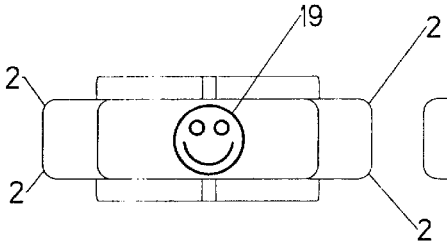
FIGS. 7A, 7B, 7C are top views showing various modifications of marks (relieves, images) on the inserts.
Figure 7B:
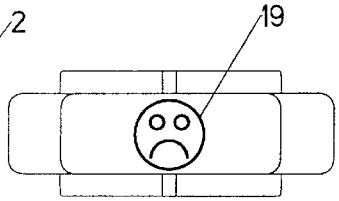
Figure 7C:
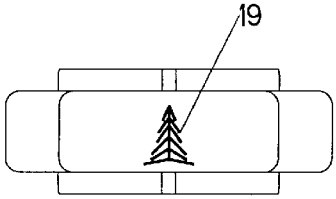
Figure 8A:
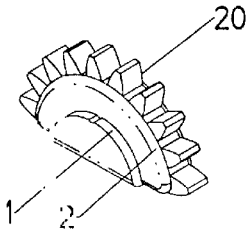
FIG. 8A is a perspective view of a logical game element formed as ½ of a cylinder, with fixing members formed as recesses on the projections and with teeth on the cylindrical surface of the element.
Figure 8B:
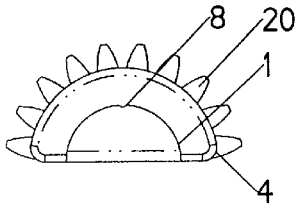
FIGS. 8B and 8C are a front view and a right view of the logical game element of FIG. 8A.
Figure 8C:
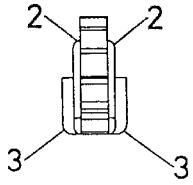
Figure 9A:
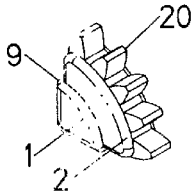
FIG. 9A is a perspective view of a logical game element formed as ¼ of a cylinder, with fixing members formed as steps on the projections and with teeth on the cylindrical surface of the element.
Figure 9B:
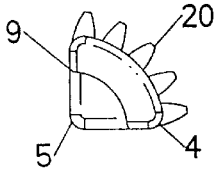
FIGS. 9B and 9C are a front view and a right view of the logical game element of FIG. 9A.
Figure 9C:
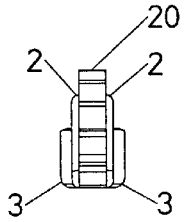
Figure 10A:
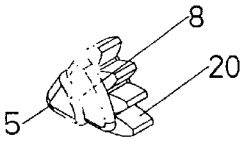
FIG. 10A is a perspective view of a logical game element formed as ⅙ of a cylinder, with fixing members formed as recesses on the projections and with teeth on the cylindrical surface of the element.
Figure 10B:
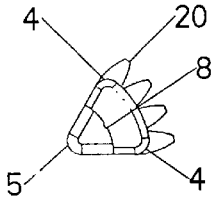
FIGS. 10B and 10C are a front view and a right view of the logical game element of FIG. 10A.
Figure 10C:
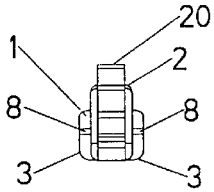
Figure 11A:
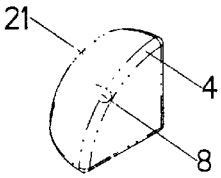
FIG. 11A is a perspective view of a logical game element formed as ⅛ of a sphere with fixing members formed as recesses on the surface of the sphere.
Figure 11B:
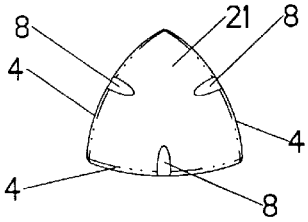
FIGS. 11B and 11C are perspective front view and perspective rear view of the logical game element of FIG. 11A.
Figure 11C:
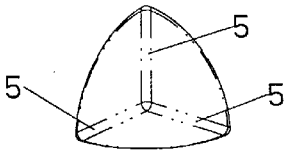
Figure 11D:
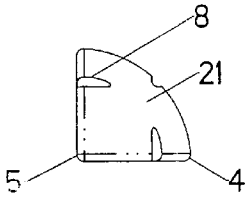
FIGS. 11D, 11E and 11F are a left view, a front view and a right view of the logical game element of FIG. 11A.
Figure 11E:
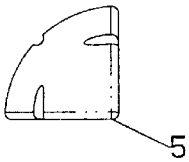
Figure 11F:
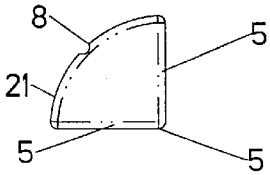

The insert 14 can tightly engage into the front slot 10 and be retained in it, since the slot 10 is formed as a dovetail as shown for example in FIGS. 4A, 4B, 4C. The inserts 15 and 16 have setting projections 17 so as to provide a possibility of pressing of the inserts into the opening 13, located at the base of the slot 11 or on the flat 12 as shown in FIGS. 5A, 5B, 5C, 6A, 6B, 6C. Massage projections 18 can be formed on the inserts 14, 15 for action on nervous centers of fingers during displacement of the logical game elements as shown in FIGS. 4A, 4B, 4C, 5A, 5B, 5C. Also, various reliefs and images 19 can be applied on the logical game elements, such as shown in FIGS. 7A, 7B, 7C, so as to provide different games, develop a logical thinking, a spacial imagination, sensitivity of fingers, etc.

Instead of the reliefs 6, the surface of the logical game element can be provided with teeth 20 which form the elements as a part of a gear (½, ¼, ⅙, etc). However, the radii 2, 3, 4, 5 and also the fixing members 7, 8, 9 remain in this elements, as shown in FIGS. 8A–10C. The teeth 20 make possible an interaction between the logical game elements by engaging the logical game elements with one another. It improves the attractiveness of the games, expands the possibilities of forming new attractive logical and mechanical games and toys. The logical game element can be formed as ½, ¼, ⅛ of a sphere 21. The surface of the sphere can be provided with at least one fixing member 8 for fixing the position of the element as shown in FIGS. 11A, 11B, 11D, 11F, 14B.

Figure 12A:
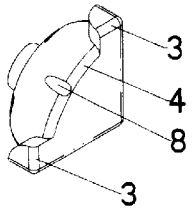
FIG. 12A is a perspective view of a logical game element formed as ⅛ of a sphere with steps on the surface of the sphere and with fixing members formed as recesses on the surface of the sphere.
Figure 12B:
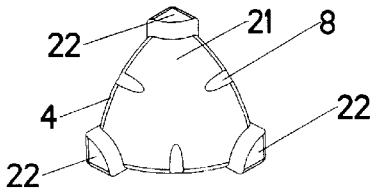
FIGS. 12B and 12C are a front and a rear perspective view; of the logical game element of FIG. 12A.
Figure 12C:
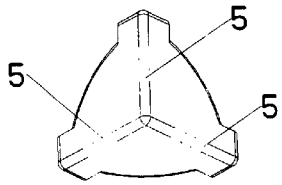
Figure 12D:
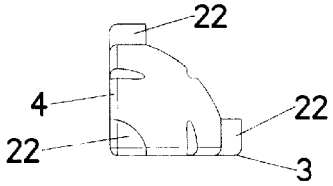
FIGS. 12D, 12E and 12F are a left view, a front view and a right view of the logical game element of FIG. 12A.
Figure 12E:
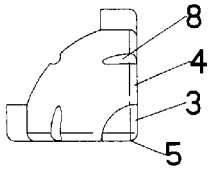
Figure 12F:
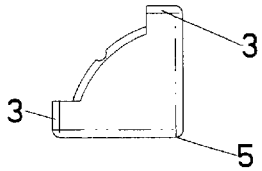
Figure 13A:
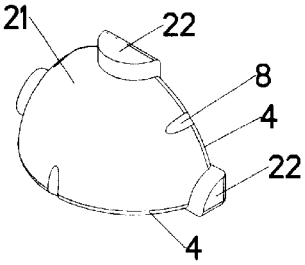
FIG. 13A is a perspective view of a logical game element formed as ¼ of a sphere, with steps on the surface of the sphere and with fixing members formed as recess on the surface of the sphere.
Figure 13B:
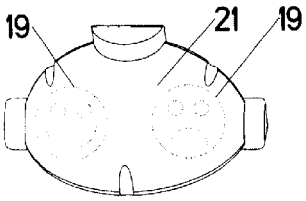
FIG. 13B is a perspective view from the front with examples of marks (relieves, images) on the surface of the sphere.
Figure 13C:
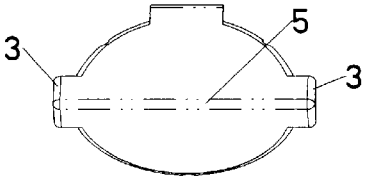
FIG. 13C is a rear view.
Figure 13D:
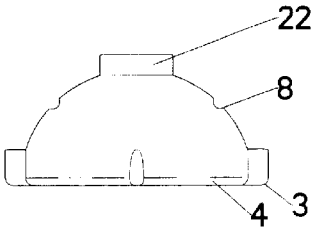
FIGS. 13D and 13E are a front view and a right view of the logical game element of FIG. 13A.
Figure 13E:
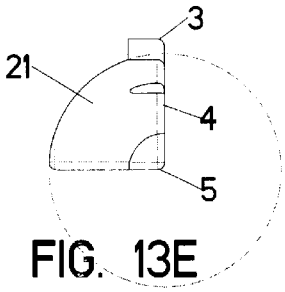
Figure 14A:
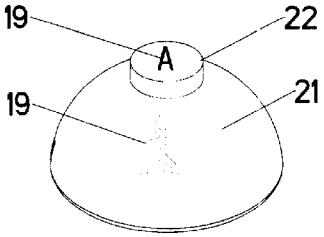
FIG. 14A is a perspective view of a logical game element formed as ½ of a sphere with a step on the surface of the sphere, with a fixing member formed as a recess on the surface of the sphere with examples of marks (relieves, images) on the surface of the sphere and on the surface of the step.
Figure 14B:
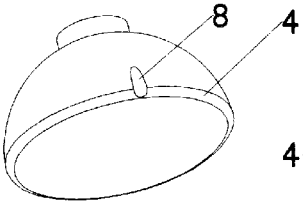
FIG. 14B is a perspective view from below of the logical game element of FIG. 14A.

The steps 22 on the surface of the sphere 21 increase the convenience and attractiveness of the game since the step 22 is an additional guide for rotation of the spherical logical game element. It is also an additional support for fingers during rotation of the element. It can be also used as an additional spot for an image 19, a mark or a relief, as shown in FIGS. 12B, 13A, 14A. The radii 3, 4, 5 still remain on the logical game element, while the radius 2 is absent since this sphere is used instead of the cylinder. Also, this element still has the fixing member 8 on the surface of the sphere as shown in FIGS. 12A–14B.

The image 19 can be applied on the surface of the sphere 21. The logical game element formed as a sphere has 6° of freedom, so that the possibility of forming new attractive logical games is expanded.

The use of fixing members and the radii is common for all logical game elements, regardless of their shape, type, the presence of slots and inserts. This makes possible to increase the convenience of the existing and future logical games. The provision of the slots, inserts, teeth, steps, images, relieves increases the attractiveness of the new games, expands a range or assortment of the new games, toys and puzzles.

Figure 15:
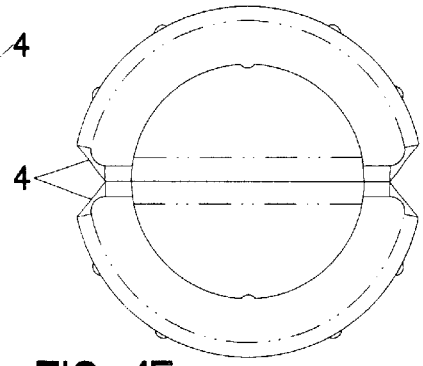
FIG. 15 is a view showing an assembly of two elements shown on the FIG. 1A; but with chamfers.
Figure 16:
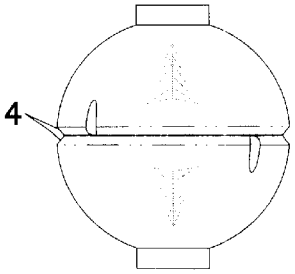
FIG. 16 is a view showing an assembly of two elements shown on the FIG. 14A but with chamfers.

The main feature of the present invention is that the radii or chamfers are provided on the sides which are located in planes to be contacted with one another or to slide over one another during assembly of an object composed of at least two logical game elements or disassembly of the same. This is illustrated in FIGS. 15 and 16. FIG. 15 shows two elements illustrated in FIG. 1A and brought in contact with one another so that they can slide over one another. The surfaces of the elements 1A which are in contact with one another and slide over one another are provided with the radii or chamfers 4. The same is true for the elements in FIG. 14A assembled as shown in FIG. 16. The surfaces which face one another and are in contact with one another and slide over one another are provided with the chamfers 4. This feature is not disclosed in the art and can not be derived from it.

It will be understood that each of the elements described above, or two or more together, may also find a useful application in other types of constructions differing from the types described above.

While the invention has been illustrated and described as embodied in logical game element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A three dimensional logical game element which forms a part of a multiple part three dimensional game assembly capable of revolving around an axis of revolution, the game element comprising at least one curved surface described by a radius and a center on the said axis and a plurality of flat surfaces extending from the said curved surface to the axis of revolution; the game element having at least one fixing member for fixing and correct positioning of the game element relative to another game element during assembly and disassembly, and to avoid displacement of the elements; the game element further having a plurality of corners whose apexes are removed on sides that slide over another element during assembly and disassembly.

2. A three dimensional logical game element as defined in claim 1, wherein said corners are rounded.

3. A three dimensional logical game element as defined in claim 1, wherein said corners are provided with chamfers.

4. A three dimensional logical game element as defined in claim 1, wherein said fixing member is formed as a recess.

5. A three dimensional logical game element as defined in claim 1, wherein said fixing member is formed as a flat area.

6. A three dimensional logical game element as defined in claim 1, wherein said body is provided with at least one projection, said fixing member being arranged on said at least one projection.

7. A three dimensional logical game element as defined in claim 1, wherein said body is formed as a sphere, said fixing member being located on said sphere.

8. A three dimensional logical game element as defined in claim 1, wherein said body has a front slot; and further comprising an insert arranged in said slot.

9. A three dimensional logical game element as defined in claim 8, wherein said insert has a shape corresponding to a shape of said front slot.

10. A three dimensional logical game element as defined in claim 8, wherein said body has a base provided with at least one setting opening for said insert, said slot being provided with at least one setting projection.

11. A three dimensional logical game element as defined in claim 8, wherein said insert has a top provided, with massaging projections.

12. A three dimensional logical game element as defined in claim 8, wherein said insert has a top provided with an image.

13. A three dimensional logical game element as defined in claim 1, wherein said body is spherical and has a spherical surface provided with an additional projection which forms a guide and a support for turning of said body.

14. A three dimensional logical game element as defined in claim 13, wherein said additional projection is provided with an image.

15. A three dimensional logical game element defined in claim 1, where said fixing member is formed as a projection.

* * * * *